US006464217B1

(12) United States Patent
Kulpa et al.

(10) Patent No.: US 6,464,217 B1
(45) Date of Patent: Oct. 15, 2002

(54) METHOD AND APPARATUS FOR LIMITING TORQUE IN A FEEDER

(75) Inventors: Walter J. Kulpa, Trumbull, CT (US); Wayne W. Pritchett, Newtown, CT (US); Paul R. Sette, Branford, CT (US); Richard A. Sloan, Jr., Southbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/439,597

(22) Filed: Nov. 12, 1999

(51) Int. Cl.[7] ..... B65H 3/06

(52) U.S. Cl. ..... 271/116; 271/121; 271/256; 198/781.01

(58) Field of Search ..... 271/116, 114, 271/256, 264, 314, 121, 124, 125; 198/781.01

(56) References Cited

U.S. PATENT DOCUMENTS 2,655,374 A * 10/1953 Townsley ..... 271/125
4,709,911 A * 12/1987 Saiki et al. ..... 271/125 X
5,172,899 A * 12/1992 Tajima ..... 271/125 X

* cited by examiner

*Primary Examiner*—David H. Bollinger
(74) *Attorney, Agent, or Firm*—Ronald Reichman; Paul A. Levitsky; Michael E. Melton

(57) ABSTRACT

A method and device for reducing the maximum torque to rollers mounted on a drive shaft of a drive roller assembly. By using a plurality of slip clutches, each for engaging an individual roller to the drive shaft and setting a maximum torque for the individual rollers, each roller is coupled to the drive shaft when the tangential force exerted on the roller does not exceed the maximum torque, and each roller is mechanically decoupled from the drive shaft when the tangential force exerted on the roller exceeds the maximum torque. Because each roller has a separate slip clutch, each roller can be mechanically decoupled from the drive shaft without affecting the other rollers coupled to the drive shaft.

7 Claims, 4 Drawing Sheets

METHOD AND APPARATUS FOR LIMITING TORQUE IN A FEEDER

TECHNICAL FIELD

The present invention relates generally to a sheet or envelope feeder and, more specifically, to the feeding mechanism of a feeder.

BACKGROUND OF THE INVENTION

Sheet and envelope feeders are commonly used in an envelope insertion system where envelopes are fed, one at a time, into an envelope inserting station, and enclosure documents are released into a gathering device for collation before the enclosure documents are inserted into the envelope at the envelope inserting station. They are also used in many different types of printers, photo copiers, print presses, and so forth. In those feeders, the most commonly used feeding mechanism is a drive roller assembly having a plurality of rollers mounted on a common shaft to be driven by a motor for rotation.

A typical envelope printer 100 is shown in FIG. 1. As shown, the printer 100 has a rack 102 for supporting a stack of envelopes 104 to be fed into the printing area 106. The feeding mechanism of the printer 100 comprises a set of six (6) drive rollers 108 for moving the envelopes 104, one at a time, into the printing area 106. On top of each drive roller 108 is a separator 110 forming a separation gap 112 to admit one (1) envelope 104 at a time into the printing area 106. The separation gap 112 is adjustable according to the thickness of the envelope 104.

In a prior art drive roller assembly 120, as shown in FIG. 2, the drive rollers 108 are fixedly mounted on a drive shaft 114. The drive shaft 114 is operatively connected to a motor 116 for rotation. A torque limiting device 118 is mounted between the motor 116 and the drive shaft 114 to set a maximum torque such that when the tangential force 122 exerted on the periphery 124 of one or more of the rollers 108 exceeds the maximum torque, all the rollers 108, along with the drive shaft 114, are mechanically decoupled from the motor 116. In order to accommodate envelopes having certain ranges of thickness, the maximum torque for a feeding mechanism in a printer is set to usually about 10 pounds. Accordingly, when the motor 116 is turning, the rollers 108 are stopped only when the tangential force 122 exceeds ten (10) pounds. If an operator accidentally inserts a finger into one of the separation gaps 112, this would result in discomfort or even injury to the operator. In order to reduce this safety hazard, it would be necessary to substantially reduce the maximum torque. However, with the driving assembly 120 as shown, it would be impractical to reduce the maximum torque far beyond the ten (10) pound limit for this would adversely affect the feeding function of the feeding mechanism.

It is, therefore, desirable to provide a method and a device for reducing the maximum torque of the driving rollers without adversely affecting the feeding function of the drive roller assembly while greatly reducing the safety hazard to the operator.

SUMMARY OF THE INVENTION

The present invention provides a method and a device for reducing the maximum torque to the rollers in a feeder for feeding substantially flat items such as printed documents, envelopes, cardboards and so forth. While the maximum torque to the individual rollers of the feeder is substantially reduced so as to greatly reduce the safety hazard to the operator, the feeding function of the feeder is not adversely affected. The device for reducing maximum torque, according to the present invention, comprises a drive roller assembly which includes: a drive shaft having a longitudinal axis operatively connected to a driving device for rotation about the longitudinal axis; a plurality of rollers mounted on the drive shaft for motion; and a plurality of torque limiting devices, each separately engaged with a roller for mechanically coupling the roller to the drive shaft and setting a maximum torque to the roller so that the roller is driven along with the drive shaft when a tangential force exerted on the roller does not exceed the maximum torque and the roller is mechanically decoupled from the drive shaft when the tangential force exerted on the roller exceeds the maximum torque, while such decoupling is accomplished without affecting the motion of the other rollers.

Accordingly, the method for reducing the torque to the drive rollers mounted on a common drive shaft in a drive roller assembly, according to the present invention, comprises the step of engaging a separate torque limiting device to each roller for mechanically coupling the roller to the drive shaft and setting a maximum torque to the roller so that the roller is driven along with the drive shaft when the tangential force exerted on the roller does not exceed the maximum torque and the roller is mechanically decoupled from the drive shaft when the tangential force exerted on the roller exceeds the maximum torque. Because each roller has a separate torque limiting device for setting the maximum torque, a roller can be mechanically decoupled from the drive shaft without adversely affecting the motion of the other rollers.

In other words, the method and device for reducing the torque to the drive rollers mounted on a common drive shaft in a drive roller assembly, according to the present invention, replaces a single torque limiting device for the entire drive roller assembly with a plurality of torque limiting devices, one for each roller. With each roller having a separate torque limiting device, the rollers will share the torque required for the entire feeding mechanism to function properly. Therefore, the maximum torque set for each of the rollers is only a fraction of the maximum torque when a single torque limiting device is used for the entire drive roller assembly.

The method and device, according to the present invention, will become apparent upon reading the description taken in conjunction with FIG. 3 to FIG. 8.

DETAILED DESCRIPTION

Figure 1:
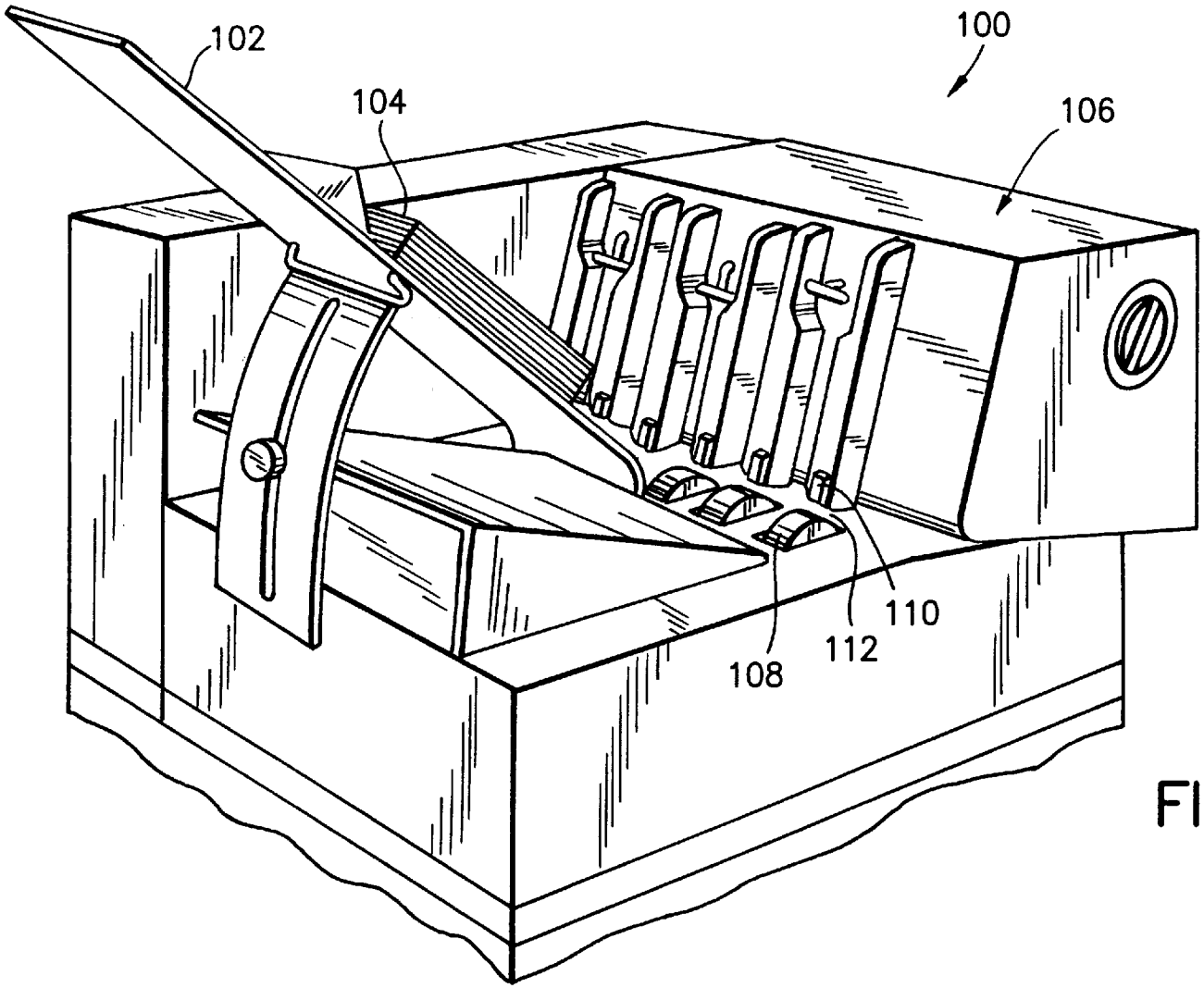
FIG. 1 is a perspective view of a typical printer having a feeder to move the materials to be printed into the printing area.
Figure 2:
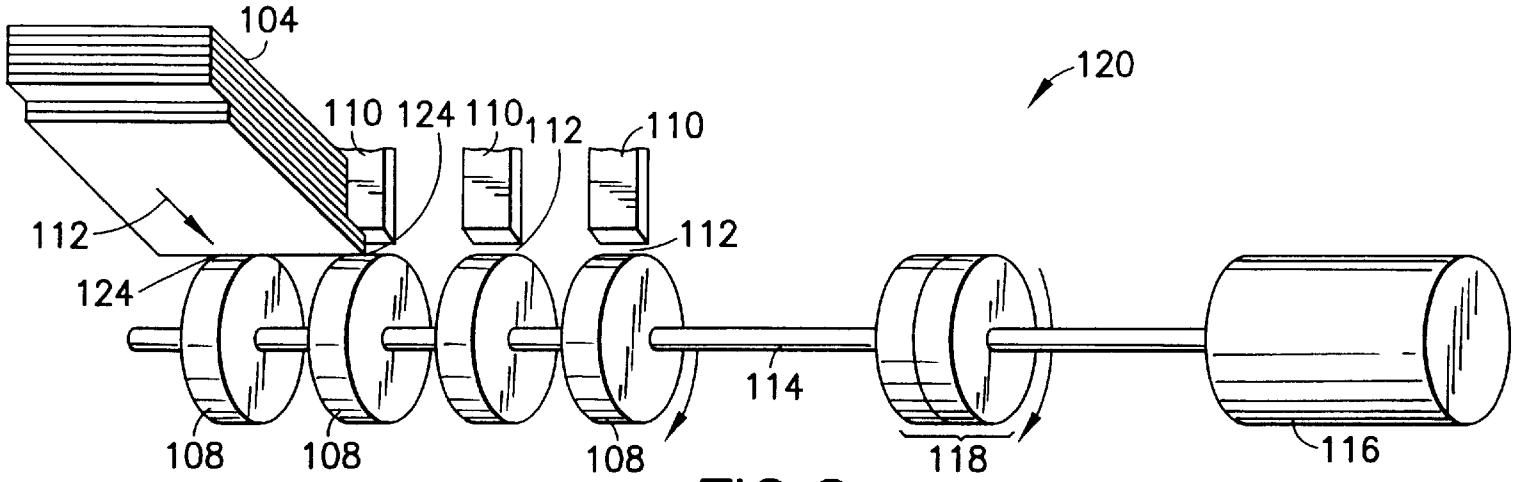
FIG.2 PRIOR ART
FIG. 2 is a schematic illustration of a prior art drive roller assembly which can be used in the feeder as shown in FIG. 1.
Figure 3:
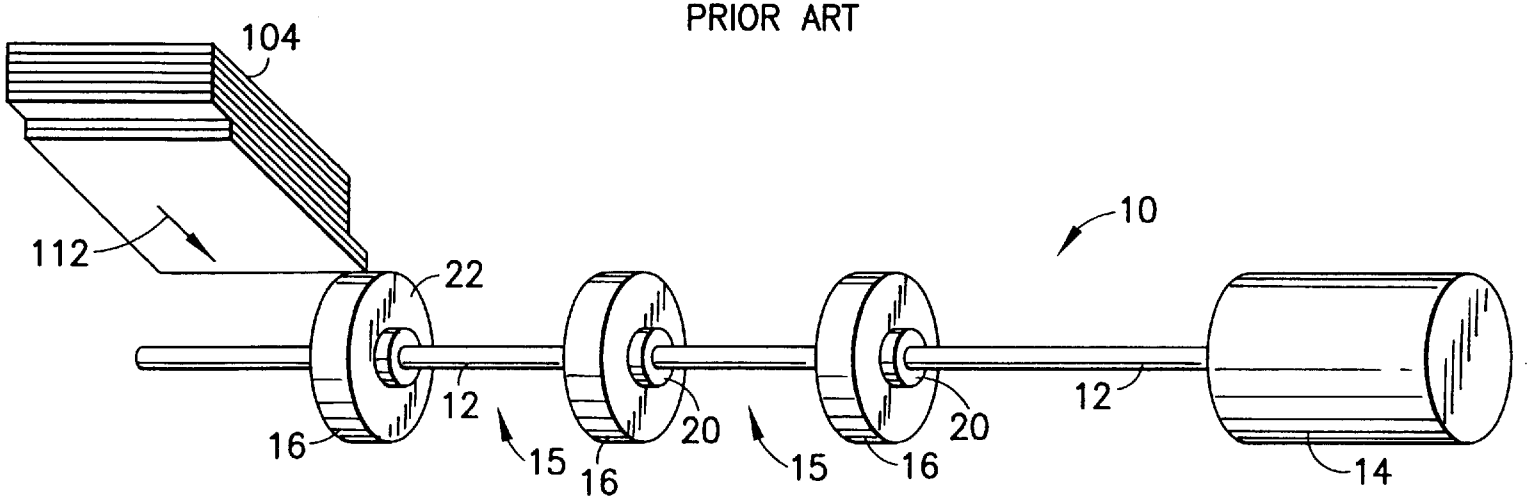
FIG. 3 is a schematic illustration of the drive roller assembly, according to the present invention, which can also be used in the feeder as shown in FIG. 1 and other feeders.

FIG. 3 illustrates a drive roller assembly 10 which can be used in a feeder for feeding substantially flat items. The drive roller assembly 10 comprises a common drive shaft 12 operatively connected to a driving device 14 for rotating motion, a plurality of rollers 16 mounted on the common drive shaft 12, with a gap 15 separating two adjacent rollers 16, and a plurality of slip clutches 20, each mounting on the drive shaft 12 to mechanically couple a roller 16 to the drive shaft 12 so that the roller 16 is driven by the drive shaft 12. Each slip clutch 20 also separately sets a maximum torque for a respective roller 16 so that when a tangential force 112 exerted on the periphery 22 of a roller 16 exceeds the maximum torque, the roller 16 is mechanically decoupled from the drive shaft 12. When decoupled, the roller 16 does not rotate along with the drive shaft 12. Because the maximum torque on each roller 16 is set by a separate slip clutch 12, the disengagement of one roller 16 does not affect the rotating motion of other rollers 16, if the tangential force 112 exerted on the periphery 22 of the other rollers 16 does not exceed the maximum torque set by the respective slip clutches 20.

With each roller 16 being torque limited by a separate slip clutch 20, the total maximum torque to the entire drive roller assembly 10 is substantially proportional to the number of the rollers 16 on the common drive shaft 12. For example, if the required feeding torque of the drive roller assembly 10 is ten (10) pounds, and there are four (4) rollers 16 mounted on the drive shaft 12 with each roller 16 having a separate slip clutch 20, then the required maximum torque for each roller 16 is substantially equal to two and one-half (2.5) pounds. It is unlikely that this maximum torque to each roller creates a safety hazard to an operator.

Accordingly, the limiting torque reduction method of the present invention includes in a drive roller assembly 10 a plurality of drive rollers 16 mounted on a common drive shaft 12, with each roller 16 operatively connected to a separate slip clutch 20 in order to mechanically couple the roller 16 to the drive shaft 12. Each slip clutch 20 separately sets a maximum torque to a respective roller 16 so that when the tangential force 112 exerted on the periphery 22 of a roller 16 exceeds this maximum torque, the roller 16 is mechanically decoupled from the drive shaft 12 without affecting the motion of the other rollers 16.

It should be noted that the drive roller assembly 10 shown in FIG. 3 is for illustrative purposes only. In practice, there are many embodiments that can be used to carry out the method of the present invention. The preferred embodiment of the present invention is illustrated in FIG. 4 through FIG. 7.

Figure 4:
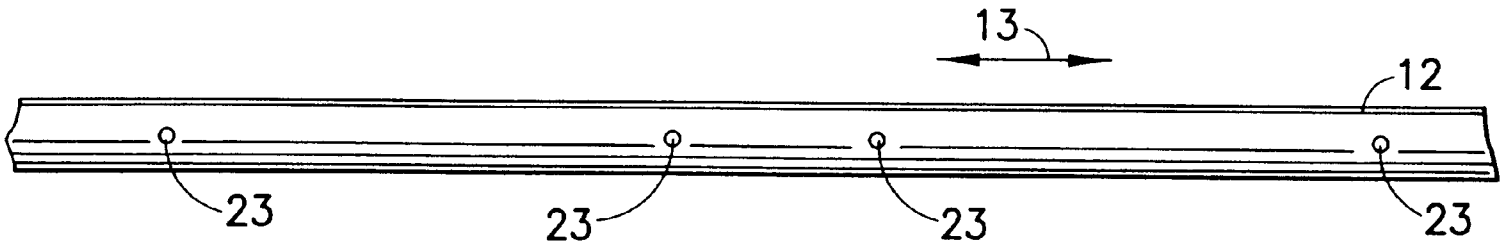
FIG. 4 is a top view of part of a drive shaft to be used in the drive roller assembly, according to the preferred embodiment of the present invention, showing four pin holes axially drilled through the drive shaft.

FIG. 4 shows part of the drive shaft 12 to be used in the drive roller assembly 10. As shown, a plurality of holes 23 are axially drilled through the drive shaft 12. Each of the holes 23 is used for fitting a dowel pin 32 as shown in FIG. 5.

Figure 5:
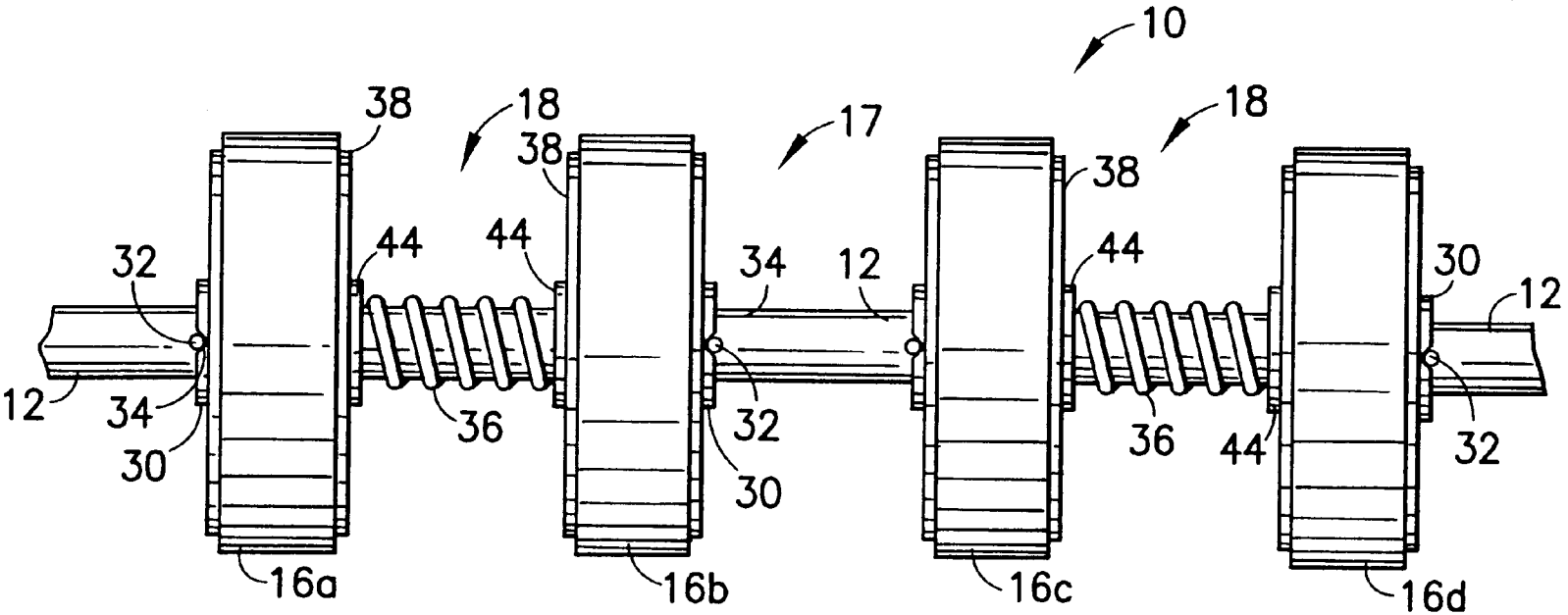
FIG. 5 is a top view of part of the drive roller assembly, according to the preferred embodiment of the present invention, showing two pairs of rollers with slip clutches.

In FIG. 5, there are shown four (4) drive rollers 16 mounted on a section of the drive shaft 12. As shown, the rollers 16 are grouped into two (2) pairs (16*a*, 16*b*), (16*c*, 16*d*), with a gap 18 between the rollers of the same pair, and a gap 17 between the pairs. Each roller 16*a*–16*d* has a hub 30 having a V-shape groove 34 (see FIG. 5) to be engaged with a dowel pin 32 to prevent the rollers 16*a*–16*d* from moving along the longitudinal axis 13 of the drive shaft 12 in normal operation. A compression spring 36 is mounted on the drive shaft 12 within the gap 18 to provide an urging force against the rollers 16*a*–16*d* of the same pair.

When the dowel pin 32 is seated in the V-shape groove 34 on the hub 30 of a roller 16*a*–16*d*, the urging force applied by the compression spring 36 creates a frictional force between the dowel pin 32 and the groove 34. When the drive shaft 12 rotates, the dowel pin 32 couples the respective roller 16*a*–16*d* to the shaft 12. However, when the tangential force 112 (FIG. 3) exerted on a roller 16*a*–16*d* exceeds the frictional force, the dowel pin 32 rides up and out of the groove 34 of the respective roller 16*a*–16*d*, mechanically decoupling the respective roller 16*a*–16*d* from the shaft 12. As the drive shaft 12 continues to rotate, the dowel pin 32 either briefly bumps through the groove 34 and allows the roller 16*a*–16*d* to keep slipping, or returns to the groove 34 to drive the roller 16*a*–16*d* if the tangential force has been reduced to below the frictional force between the dowel pin 32 and the groove 34.

In this respect, the dowel pin 32 in the groove 34 acts as a slip clutch 20 (FIG. 3) which mechanically couples the respective roller 16*a*–16*d* to the drive shaft 12 and sets the maximum torque to the respective roller 16*a*–16*d*. The maximum torque is determined partially by the friction between the dowel pin 32 and the groove 34 and partially by the urging force of the compression spring 36. Because each roller 16*a*–16*d* has a separate slip clutch (dowel pin 32 and groove 34), the motion of one (1) roller 16*a*–16*d* is not affected by whether any of the other rollers 16*a*–16*d* are mechanically decoupled from the drive shaft 12. Each roller 16*a*–16*d* is mechanically coupled by the respective dowel pin 32 to the drive shaft 12 so long as the tangential force exerted on that roller 16*a*–16*d* does not exceed the maximum torque.

Optionally, a washer 44 can be placed between the spring 34 and the engaging roller 16*a*–16*d* so as to provide a smooth sliding surface for the rollers 16*a*–16*d* during slipping.

Figure 6:
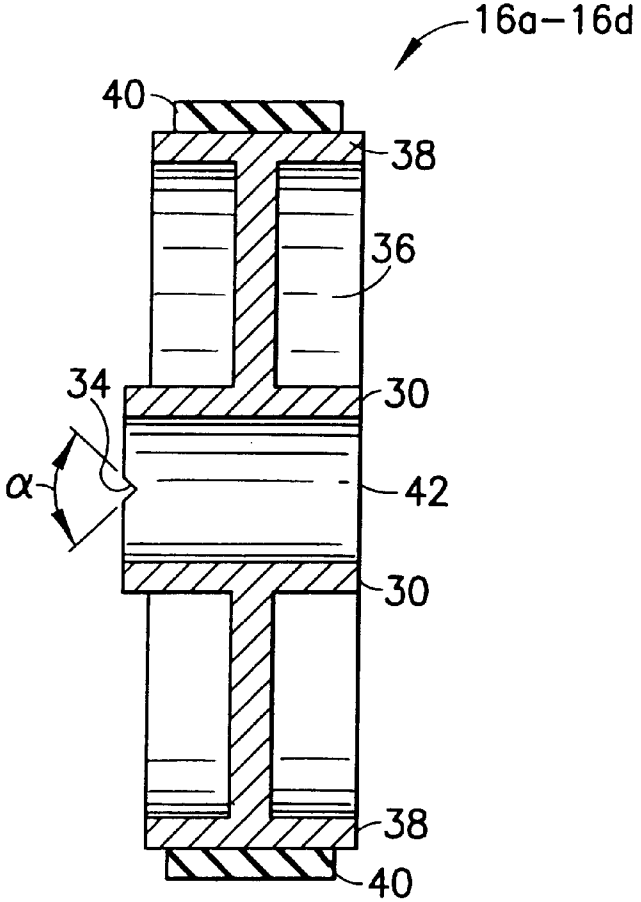
FIG. 6 is a cross sectional view of a roller showing the pulley and the hub of a roller.

FIG. 6 shows a cross-sectional view of the rollers 16*a*–16*d*. As shown, the rollers 16*a*–16*d* comprise a pulley 36 with the hub 30 which is concentric about a mounting center hole 42. The pulley 36 also has a concentric outer rim 38 to secure a roller surface 40 for moving a fed item. There is also shown the V-shaped groove 34 on the hub 30 with an inclusive angle $\alpha$. Preferably, the angle $\alpha$ is substantially equal to ninety (90) degrees.

Figure 7:
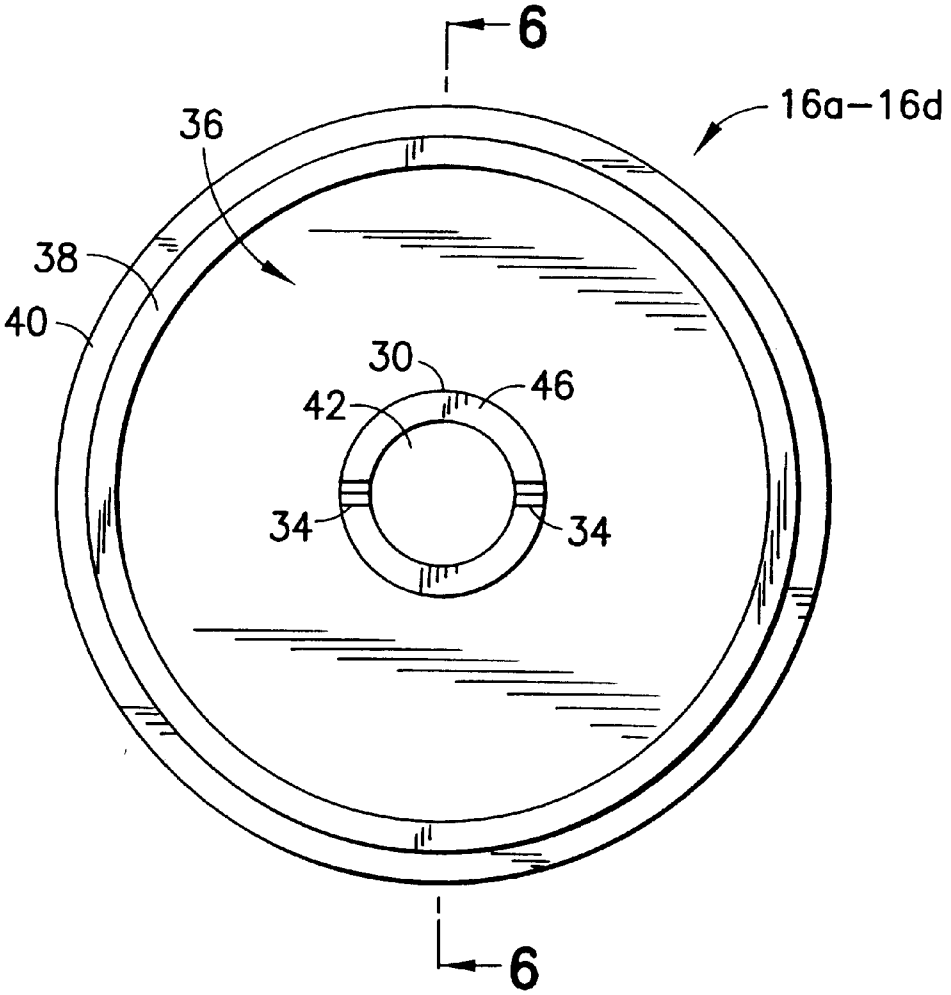
FIG. 7 is a side view of a roller showing the groove on one of the hub side-surfaces.

FIG. 7 is the side view of the rollers 16*a*–16*d* showing the groove 34 located on a side surface 46 of the hub 30. The side surface 46 is substantially perpendicular to the axis of the center hole 42. Thus, when the rollers 16*a*–16*d* are mounted to the drive shaft 12, the groove 34 and the side surface 46 are substantially perpendicular to the longitudinal axis 13 of the drive shaft 12.

Although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A drive roller assembly in a feeder, wherein the feeder encounters a tangential force during a feeding operation of substantially flat objects, said drive roller assembly comprising:

(a) a drive shaft having a longitudinal axis operatively connected a driving device for rotation about the longitudinal axis;

(b) a plurality of rollers mounted on the drive shaft for motion; and (c) a plurality of torque limiting devices comprising a slip clutch each for mechanically coupling an individual roller to the drive shaft and setting a maximum torque for the roller so that the roller is driven along with the drive shaft when the tangential force exerted on the respective roller does not the exceed the maximum torque and the roller is individually mechanically decoupled from the drive shaft when said tangential force exceeds the maximum torque, wherein each roller has a groove substantially perpendicular to the longitudinal axis of the drive shaft, said drive roller assembly further comprising:

a plurality of pins axially located on the drive shaft with each pin seated in a groove of a corresponding roller; and means for providing an urging force on each roller against the respective pin in order to create a frictional force between the pin and the groove for setting the maximum torque for the respective roller so that the pin mechanically couples the respective roller to the drive shaft when the tangential force exerted on the roller does not exceed the maximum torque and the pin rides up and out of the groove of the roller thereby mechanically decoupling the respective roller from the drive shaft when the tangential force exerted on the roller exceeds the limiting force.

2. The drive roller assembly of claim 1, wherein the rollers are grouped into pairs with a gap between each roller pair and wherein the force urging means comprises at least a compression spring mounted in the gap of the roller pair so as to provide the urging force in a direction substantially perpendicular to the longitudinal axis of the drive shaft.

3. The drive roller assembly of claim 2, wherein each roller has a pulley connecting the hub to an outer rim concentric to the drive shaft, the outer rim providing a roller surface for feeding the substantially flat objects.

4. The drive roller assembly of claim 1, wherein each roller has a hub having a side surface substantially perpendicular to the longitudinal axis of the drive shaft for forming the groove in the roller.

5. The drive roller assembly of claim 1, wherein the groove in each roller is V-shaped.

6. The drive roller assembly of claim 5, wherein the groove has an inclusive angle substantially equal to ninety (90) degrees.

7. The drive roller assembly of claim 1, further comprising a plurality of washers each placed between a respective roller and the force urging means so as to provide a smooth surface for smooth slipping when the roller is mechanically decoupled from the drive shaft.

* * * * *